United States Patent [19]

Macmorine et al.

[11] Patent Number: 4,642,974

[45] Date of Patent: Feb. 17, 1987

[54] MACHINE FOR FOLDING FLANGES OF BLISTER PACKAGE

[75] Inventors: David R. L. Macmorine, Mississauga; Andrzej Maczvszenko, Scarborough; Terence F. Karley, Mississauga, all of Canada

[73] Assignee: Macmorine Fabrications Ltd., Toronto, Canada

[21] Appl. No.: 832,010

[22] Filed: Feb. 24, 1986

[51] Int. Cl.[4] ..... B31B 17/26; B65B 47/02

[52] U.S. Cl. ..... 53/558; 53/289; 493/102; 493/178; 493/438

[58] Field of Search ..... 53/289, 287, 169, 558, 53/375, 374, 486, 485, 471, 559; 493/438, 178, 179, 177, 102

[56] References Cited

U.S. PATENT DOCUMENTS

| | | | |
|---|---|---|---|
| 1,439,850 | 12/1922 | Teeple | 493/178 |
| 2,512,074 | 6/1950 | Sandberg | 493/438 X |
| 2,886,933 | 5/1959 | Hennies, Jr. | 493/102 X |
| 3,245,680 | 4/1966 | Harrison et al. | 493/438 X |
| 3,263,393 | 8/1966 | Weber | 53/486 |
| 3,588,089 | 6/1971 | Flanagan | 493/438 X |
| 3,597,900 | 8/1971 | Scott | 53/375 |
| 3,707,274 | 12/1972 | Hausler et al. | 53/486 |

*Primary Examiner*—James F. Coan

*Attorney, Agent, or Firm*—Fetherstonhaugh & Co.

[57] ABSTRACT

A flange folding machine for folding the distal end of the flanges of a blister package or the like inwardly upon the proximal ends thereof to form closure panel receiving channels. The machine comprises, a plurality of carriers mounted on a conveyor for continuous movement through a folding station, a side flange folding mechanism, a first heater located in close proximity to each first fold line and being operable to heat the side flanges to a sufficient extent to render them formable. The mechanism may also include a leading end flange forming mechanism for folding the distal end portion of a leading end flange inwardly upon the proximal end portion thereof along a transverse foldline. The leading end flange forming mechanism comprises a second heater which is mounted on a carriage which is slidably mounted for reciprocating movement in the folding station to and fro along between a forward position and the retracted position.

9 Claims, 13 Drawing Figures

MACHINE FOR FOLDING FLANGES OF BLISTER PACKAGE

This invention relates to a machine for forming the flanges of a thermoplastic package.

PRIOR ART

In the manufacture of blister packages it is common practice to form a pocket in a web of thermoplastic material so that flanges project laterally from the pocket. Two or more of these flanges must be folded inwardly to form a slipway for receiving a closure wall of the package which is usually in form of a card which is printed to identify the product which is shipped in the package.

The mechanisms which have been developed for the purposes of folding the flanges are complex mechanisms which are not capable of reliable high speed operation.

When the side flanges of the package are folded to form channels for receiving the closure wall difficulty is frequently experiences in attempting to insert the closure wall because the channel formed by folding is of a generally V-shaped configuration with the result that the opposite side edges of the insert card tend to become wedged into the base of one or other or both of the V-shaped channels.

SUMMARY OF INVENTION

It is an object of the present invention to provide a simple and inexpensive flange folding machine suitable for use in folding at least the side flanges of a blister package or the like.

According to one aspect of the present invention, a flange folding machine for folding the distal end of the flanges of a blister package or the like inwardly upon the proximal ends thereof to form closure panel receiving channels comprises a plurality of carriers mounted on a conveyor for continuous movement along a path which extends through a folding station, each carrier being adapted to support a package with the distal ends of its flanges projecting outwardly therefrom, side flange folding means in said folding station at opposite sides of said path for folding the distal ends of the side flanges along a first fold line, said side flange folding means having a first length adapted to fold the distal end of the side flanges to an upright position and a second length adapted to fold the distal end of the flanges inwardly to overlie their proximal ends, said flange folding means including mandrel means extending along said second length and located at said fold line whereby the flanges are folded around said mandrel means to form inwardly opening channels which have a wide base to facilitate the sliding of a closure panel therealong, and first heater means located in close proximity to each first fold line and extending along at least a major portion of said first length and being operable to heat said side flanges to a sufficient extent to render them formable.

According to a further aspect of the present invention the flange folding machine described in the preceeding paragraph also has a leading end flange folding means for folding the distal end portion of a leading end flange inwardy upon the proximal end portion thereof along a transverse fold line which comprises heater means slidably mounted for reciprocating movement in said folding station to and fro along said path between a forward position and the retracted position, said heater means being operable to heat the leading end flange of successive packages along their transverse fold lines, said heater means and each carrier having complementary abuttment means arranged to butt against one another thereby to cause the heater means to travel with successive carriers from said forward position to said retracted position to provide a sufficient dwell time to permit the heater means to render the leading end flange foldable along said transverse fold line, release means for releasing said abutting means when said heater means reaches said retracted position, return means for returning said heater means to said forward position, and end flange folding means mounted in said folding station and arranged so as to engage said leading end flange and fold the distal end thereof along said transverse fold line to a position overlying said proximal end as said carrier is driven continuously through said folding station.

The invention will be more clearly understood after reference to the following detailed specification read in conjunction with the drawings wherein.

Figure 1:
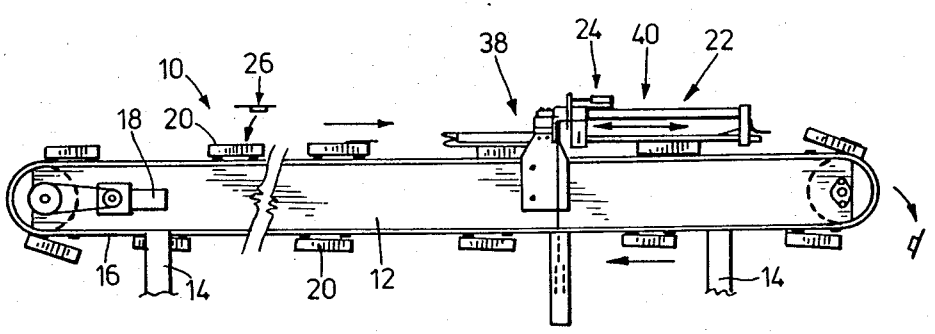
FIG. 1 is a side view of a flange folding machine constructed in accordance with an embodiment of the present invention.
Figure 4:
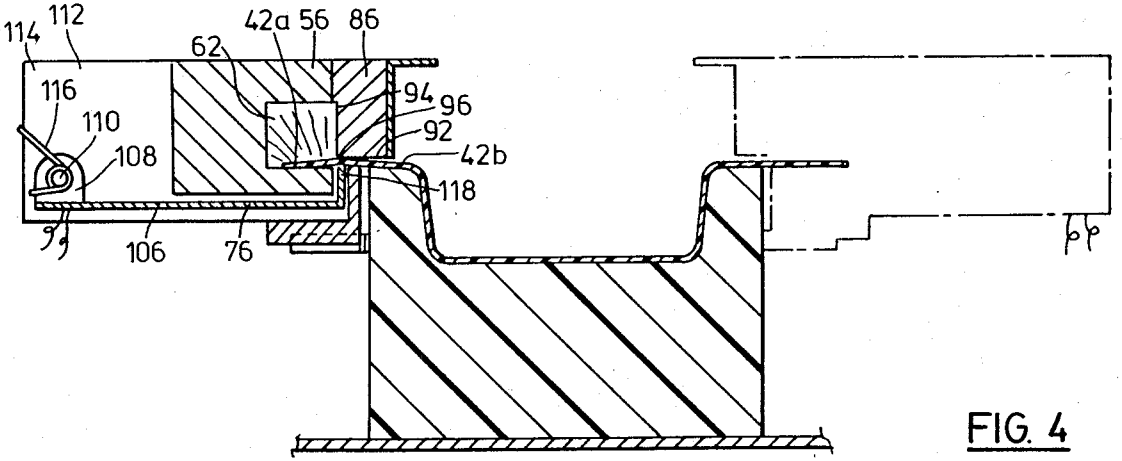
Figure 2:
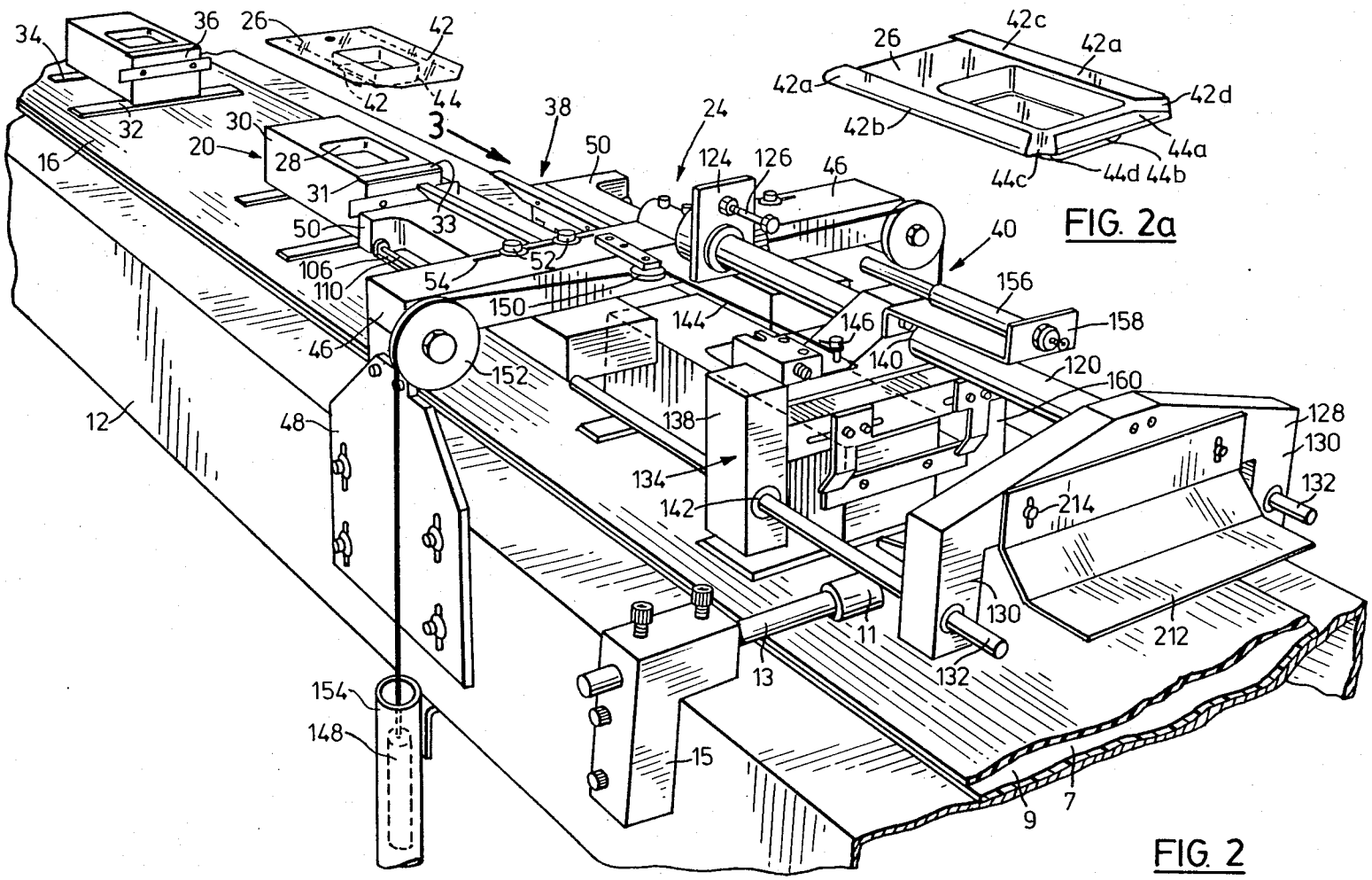
FIG. 2 is a top pictorial view of a portion of the flange folding machine of FIG. 1.
Figures 3, 3A:
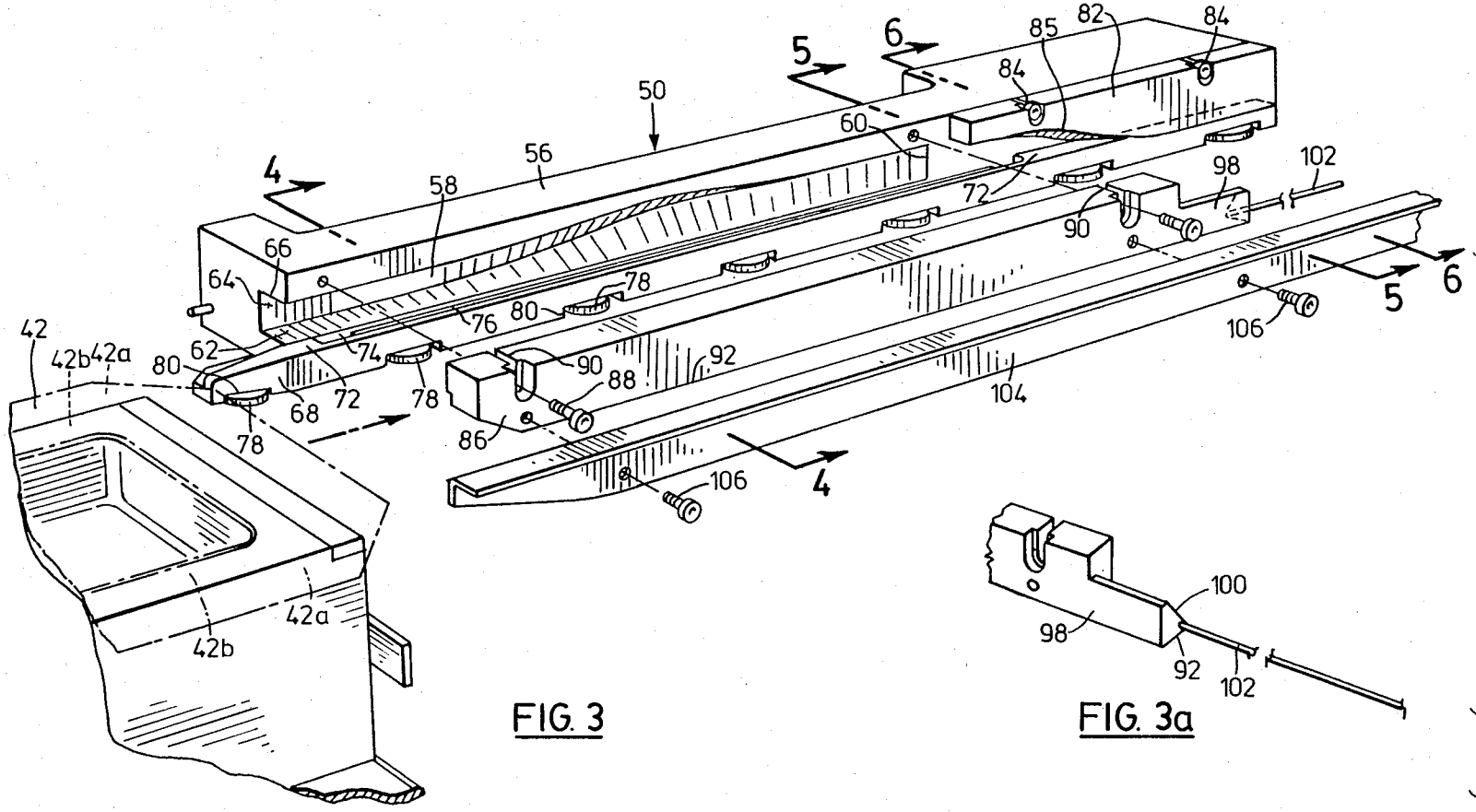
Figure 5:
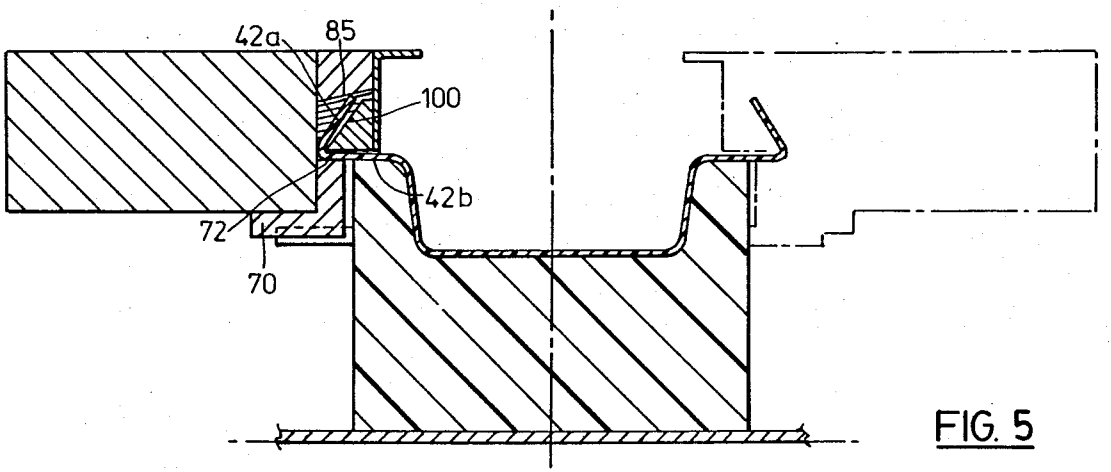
Figure 6:
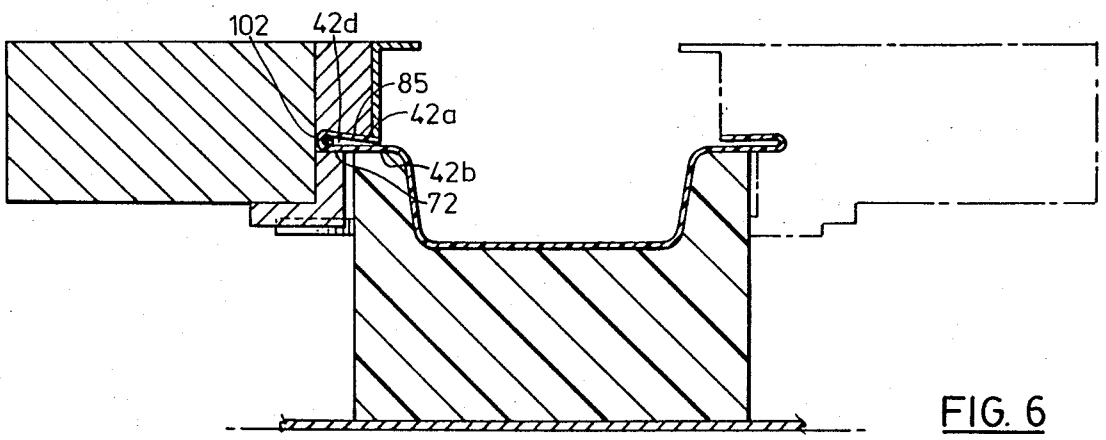
Figure 7:
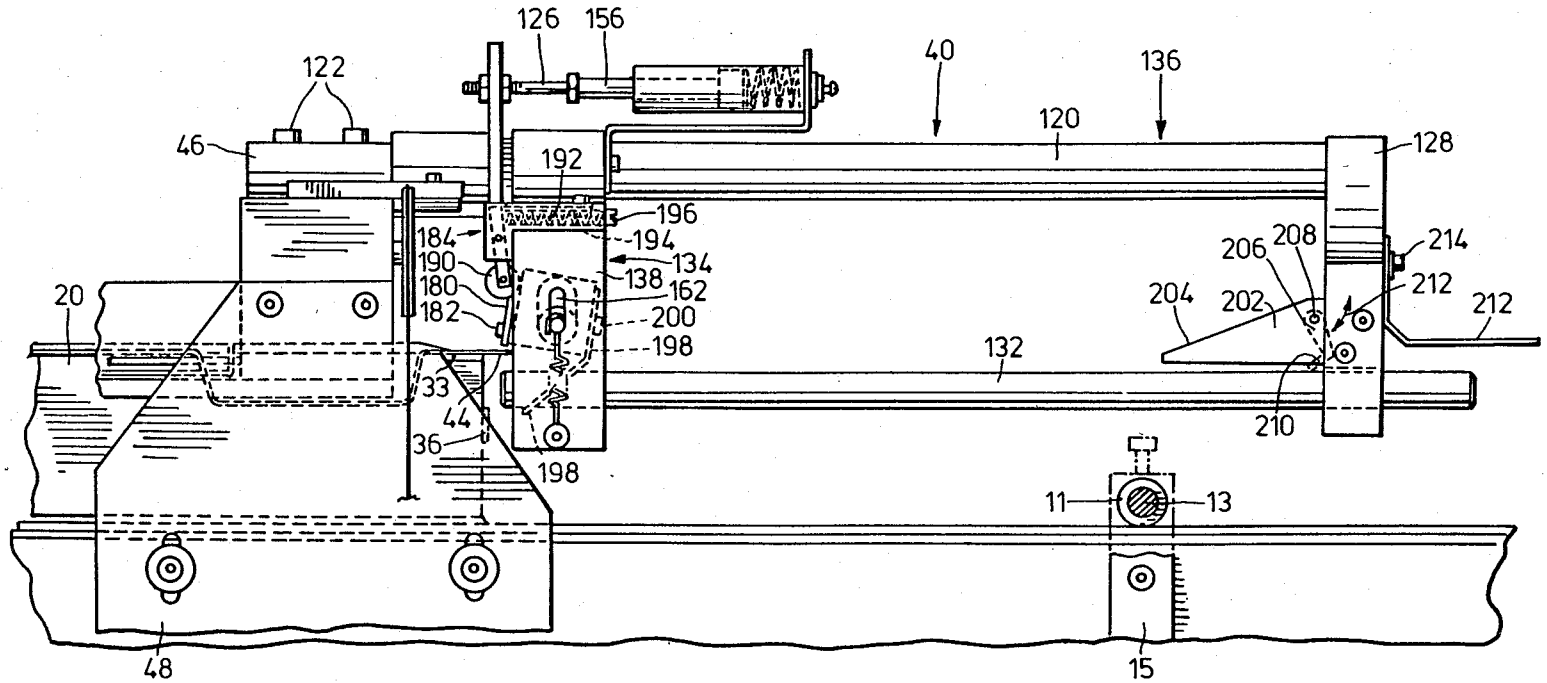
Figure 8:
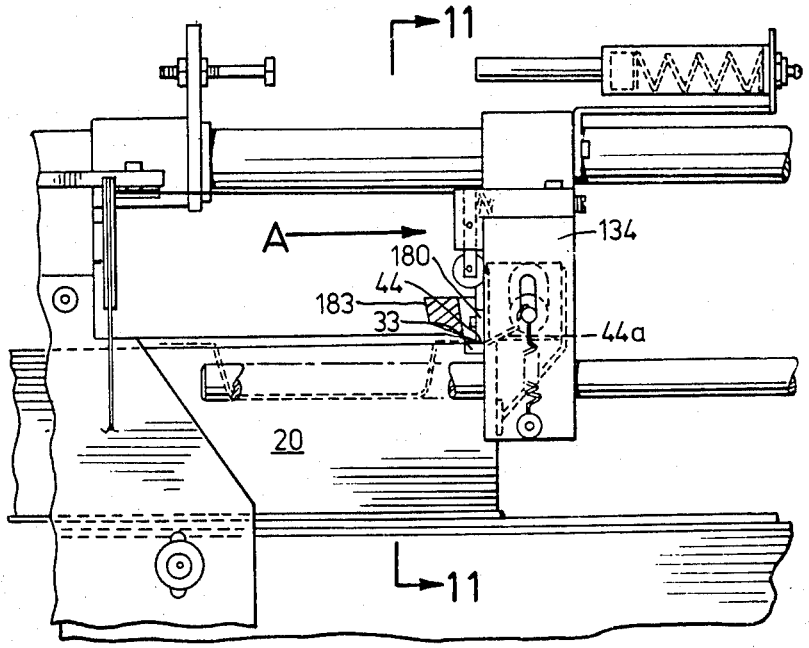
Figure 9:
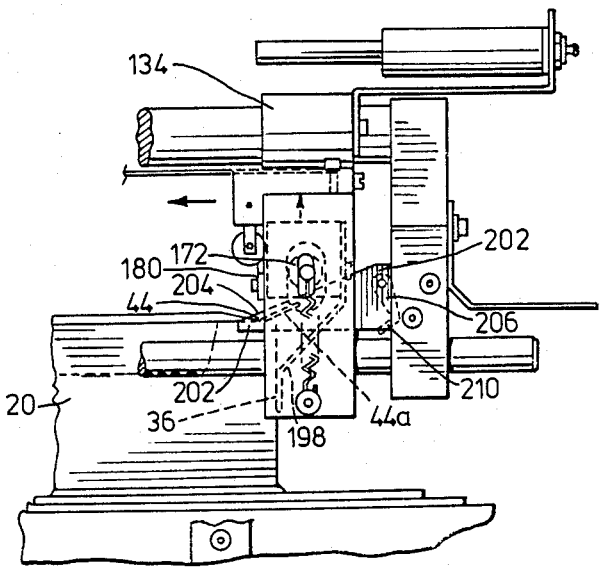
Figure 10:
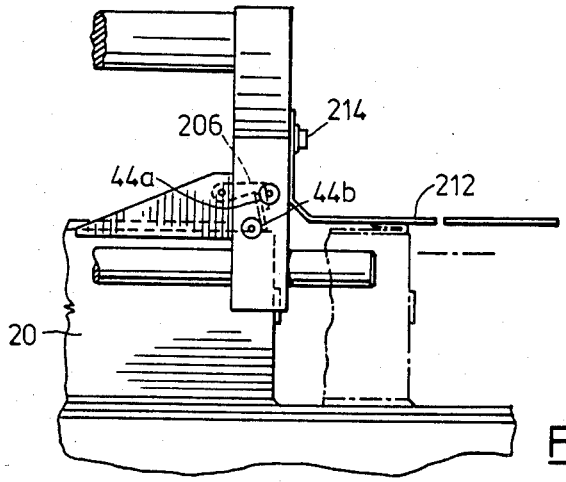
Figure 11:
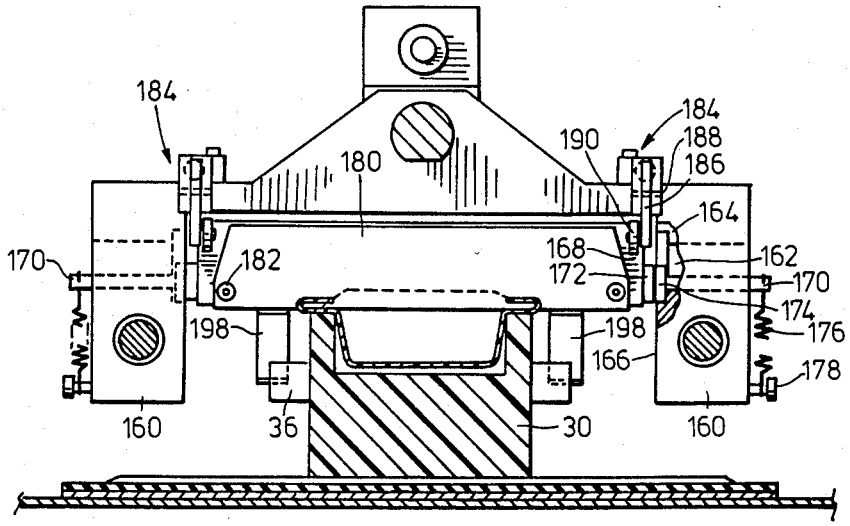

FIG. 2*a* is a top pictorial view of a blister package showing the flanges in the final folded configuration;

FIG. 3 is a view in the direction of the arrow 3 of FIG. 2 showing one side flange folding mechanism in a partially exploded configuration;

FIG. 3*a* is a pictorial view illustrating the manner in which the folding mandrel is secured to and extends rearwardly from the folding anvil;

FIG. 4 is a sectional view taken along the line 4—4 of FIG. 3;

FIGS. 5 and 6 are sectional views similar to FIG. 4 showing subsequent steps in the side flange folding operation;

FIG. 7 is an enlarged side elevation of the folding mechanism of FIG. 1 showing the forward position of the heater carriage;

FIG. 8 is a side view of a portion of the mechanism of FIG. 7 showing an intermediate position of the heater carriage;

FIG. 9 is a side view similar to FIG. 7 showing the retracted position of the heater carriage;

FIG. 10 is a side view similar to FIG. 9 illustrating the operation of the folding hook and fold down plate; and FIG. 11 is a sectional view taken along the line 11—11 of FIG. 8.

With reference to FIG. 1 of the drawings the reference number 10 refers generally to a flange folding machine constructed in accordance with an embodiment of the present invention. The flange folding machine comprises a main frame 12 which is supported by legs 14 and upon which a conveyor belt 16 is mounted. A motor 18 is drivingly connected to the conveyor belt 16 and operable to provide continuous movement of the conveyor belt 16. A plurality of carriers 20 are mounted on the conveyor belt 16 at spaced intervals along the length thereof. The conveyor belt 16 is retained against the upper face 7 of the runway 9 by means of a plurality of rollers 11 which are rotatably mounted on shafts 13 which are supported by brackets 15 at a plurality of spaced intervals along the length of the conveyor. The conveyor belt 16 operates to continuously drive the carriers 20 through a flange folding station generally identified by the reference numeral 22 in which a flange folding mechanism generally identified by the reference numeral 24 is located. Blister packages generally identified by the reference numeral 26 are located in pockets 28 (FIG. 2) and are transported through the folding station 22 and thereafter discharged from the pockets.

With reference to FIG. 2 of the drawings it will be seen that each of the carriers 20 comprises a housing block 30 in which the pocket 28 is formed. The housing blocks 30 are held fast with respect to the conveyor 16 by means of the forward mounting strap 18 and rest upon a rear support strap 34. Each housing block 30 has a recess 31 formed at the upper leading end thereof within which a rubber-like insert is located to form a backing which will yield under the pressure applied by the heating element as will be described hereafter. A first abuttment bar 36 is mounted at the forward end of each carrier 30 and projects laterally from opposite sides thereof.

The flange folding mechanism 24 includes a side flange folding mechanism 38 and a leading end flange folding mechanism 40.

With reference to FIG. 2 of the drawings it will be seen that the blister package 26 has a pair of oppositely disposed side flanges 42 and a leading end flange 44. As shown in FIG. 2*a* of the drawings in the final product the distal end portions 42*a* are folded inwardly along fold lines 42*b* to overlie the proximal end portions 42*c*.

Similarly, the distal end portion 44*a* of the leading end flange 44 is folded along the fold line 44*b* to overlie the proximal end portion 44*c*. As will be described hereinafter, the channel 42*d* which is formed by folding the side flanges 42 inwardly as a generally rounded base whereas the channel 44*d* has a generally V-shaped configuration.

The flange folding mechanism 24 includes a bridge member 46 which is secured to the main frame 12 by means of side plates 48 and which bridges the path along which the carriers 20 are transported through the flange folding station 22. The side flange folding mechanism 38 comprises a pair of side flange folding assemblies 50 each of which are secured to the bridge member 46 by means of mounting screws 52 which extend through slots 54 which are formed in the bridge member 46 to permit lateral adjustment of the side flange forming assemblies 50 to accommodate blister packages of different widths. The side flange forming assemblies 50 are identical and of opposite hand and one such assembly is illustrated in an exploded condition in FIG. 3 of the drawings to which reference is now made. The assembly 50 consists of a first longitudinally elongated member 56 which has a flange upsetting channel 58 extending from the front end thereof and terminating at the point 60. The upsetting channel 58 has an upsetting face 62 which is initially horizontally oriented and which moves progressively to an upright configuration until the point 60 at which it is fully upright. The outer face 64 and top face 66 progressively diminish from the upstream end to accommodate the change in attitude of the upsetting face 62.

A first heater assembly 68 is provided for the purposes of heating the side flanges along their fold line. The first heater assembly 68 consists of an L-shaped bar which has an upper face 72 which extends side-by-side with the inner edge of the upsetting face 62. A notch 74 is formed in the upper face 72 and an electrical heating element 76 is located in the notch 74 and extends longitudinally thereof.

Guide rollers 78 are mounted for free rotation in notches 80 and project outwardly from the L-shaped bar 70 to space the side faces of successive carriers from the side faces of the L-shaped bar 70 to prevent frictional contact therebetween.

The distal portions of the side flanges are folded inwardly to overlie the proximal portions thereof by means of a plough blade 82 which is secured to the longitudinally elongated member 56 by means of mounting screws 84. The plough blade 82 has a plough face 86 which extends downwardly from the upstream end thereof to a position in which it serves to locate the distal end portion 42*a* of the flanges of the package in an overlying relationship with respect to the proximal end portions 42*b*.

The proximal portions 42*b* of the side flanges are retained during the initial folding of the distal portions 42*b* by means of a retainer bar or anvil 86 which is secured to the longitudinally elongated member 56 by means of mounting screws 88 which extend through elongated slots 90 which are formed in the retainer bar 86 and which permit vertical adjustment of the spacing between the retainer bar 86 and upper face 72 of the L-shaped bar 70 to accommodate flanges of different thicknesses. The retainer bar 86 has a lower face 92 (FIG. 4) which is horizontally oriented and an outer side face 94 which is vertically oriented and which cooperate with one another to form a folding edge 96 about which the distal end 42*a* is folded to the upright position by the upsetting face 62.

The retainer bar 86 has an extension 98 extending from the downstream end thereof and as shown in FIGS. 3*a* and 4 of the drawings the extension 98 has an inclined outer face 100. A circular rod 102 has one end secured to the extension 98 adjacent the corner formed between the inclined face 100 and the lower face 92. The rod 102 has a circular cross section and is of small diameter. The rod 102 is longitudinally elongated and extends to the downstreamed of the side flange forming assembly. The upper face 72 of the L-shaped bar 70 provides a support for the rod 102 when it is not positioned along the fold line of a package in use.

An L-shaped outer face plate 104 is secured to the retainer bar 86 by means of mounting screws 106.

As previously indicated, an electrical heating element 76 extends into the notch 74. The structure of the heating element will be more clearly understood with reference to FIG. 4 of the drawings wherein it will be seen that the heating element 76 comprises an L-shaped heater bar 106 which has flanges 108 projecting upwardly therefrom. The flanges 108 are pivotally mounted on a shaft 110 opposite of which are mounted in the end faces 112 of the notch 114 which is formed on the outer face of the longitudinally elongated member 56. A spring 116 is arranged to normally urge the inner end 118 of the heater bar 76 toward the folding edge 96 of the retainer bar 86 to bear against the fold line of the side flange to heat the side flange along the fold line in use.

FOLDING OF SIDE FLANGES

In some applications it is only necessary to fold the side flanges of the blister package and in such applications the apparatus described above is all that is required. In use a blister package 26 is loaded in the pockets 28 of successive housing blocks 30 and is driven through the folding station. The proximal end portion 42*b* of the side flanges 42 are retained between the upper face of the carriage and the retainer bar 86 and as shown in FIG. 4 of the drawings the heating element 76 contacts the side flanges directly opposite the folding edge 96. The speed of travel of the conveyor 16 is such that the flange 42 will be in contact with the heater 76 for a sufficient period of time to render it sufficiently plastic to permit the distal end portion 42 to be upset by contact with the upsetting face 62 and subsequently folded by contact with the plough face 85 of the plough blade 82. As shown in FIG. 6 of the drawings, the plough face 85 folds the distal flange portion 24*a* around the bar 102 to an extent that it insures that the channel 42*d* is formed with the rounded base.

LEADING END FLANGE FOLDING MECHANISM

As previously indicated, the flange folding machine 10 of the illustrated embodiment also includes a leading end flange folding mechanism 40.

The leading end flange forming mechanism 40 will now be described with reference to FIG. 2 and FIGS. 7 to 11 of the drawings. The mechanism 140 includes a shaft 120 which is rigidly secured with respect to the bridge member 46 by means of mounting screws 122. A stop plate 24 is mounted on the shaft 120 and an adjustable buffer 126 is mounted on the stop plate 124. A second bridge 128 is mounted at the downstream end of the shaft 120. The second bridge 128 has arms 130 which depend on opposite sides of the path of travel of the housing blocks 30. Guide rails 132 are mounted in each arm and extend forwardly therefrom.

A heater assembly generally identified by the reference numeral 134 is slideably mounted on the shaft 120 and guide rails 132 for movement between a forward position illustrated in FIG. 7 of the drawings and a retracted position illustrated in FIG. 9 of the drawings.

The bridge members 46 and 128 together with the shaft 120 and guide rails 132 form the support frame generally identified by the reference numeral 136 on which the heater assembly 134 is slideably mounted. The heater assembly 134 has a carriage 138 which is formed with passages 140 and 142 which are adapted to slideably receive the shaft 120 and guide rails 132. Cables 144 have one end secured to pins 146 which are mounted on the carriage 138 and another end secured to a weight 148. The cables 144 extend around pulleys 150 and 152 which are mounted on the bridge 46. The weight 148 is located within the sleeve 154 in a free-fitting sliding relationship. The weight 148 serves to urge the carriage 138 toward the advanced position illustrated in FIG. 7 of the drawings. A shock absorbing buffer 156 is mounted on a bracket 158 which is secured to the carriage 138. The shock absorbing buffer 156 is aligned with the buffer 126 and will serve to arrest the forward movement of the carriage 138 when it makes contact with the buffer 126. The carriage 138 has lags 160 which are spaced from one another. The lags 160 have vertically elongated slots 162 extending laterally therethrough (FIG. 11). The slots 160 each have a recess 164 formed at the inner face 166 of the lags 160. A heater support block 168 is located between the lags 160 and has shafts 170 projecting from opposite ends thereof through slots 162. Rollers 172 and 174 are mounted on the shafts 170. Tension springs 176 have one end hooked over the shaft 170 and another end hooked over a mounting pin 178 which is secured to the lag 160. The tension springs serve to normally urge the shafts 170 to the lower most position in the slots 160 as illustrated in FIG. 7 of the drawings. In addition to being vertically moveable, the heater support block 168 is rotatable about the axis of the shafts 170 so as to be moveable from the angularly inclined position shown in FIG. 7 of the drawings to the generally upright position shown in FIG. 8 of the drawings. A heater element 180 is secured to the upstream end of the support block 168 by mounting screws 182. A stripper bar 183 is mounted on the carriage 138 and serves to separate the heating element 180 from the heated leading end flange 44 as the heating element 180 is raised. The heater support block 168 is normally urged to the angularly inclined position shown in FIG. 7 of the drawings by means of two biasing mechanisms generally identified by the reference numeral 184. Each biasing mechanism includes a lever 186 which is pivotally mounted on a pivot pin 188. A roller 190 is located atone end of the lever arm 86 and bears against the upstream face of the heater support block 168. A compression spring 192 is mounted in a passage 194 which is formed in the carriage 138 and which is closed at one end by an adjustment screw 196. The compression spring bears against the other end of the lever arm 186 and urges the roller 190 against the upstream end of the heater support block 168. Thus, the biasing mechanism 184 tends to bias the heater support block toward the inclined position illustrated in FIG. 7 of the drawings.

A second abuttment is provided by means of fingers 198 which are secured to the downstream end of the heater support 168 by means of mounting screws 200. The fingers 198 extend downwardly as shown in FIG. 11 of the drawings, one on either side of the path of travel of the housing block 30, in alignment with the first abuttment bar 36.

Elevator ramps 202 are mounted on the second bridge 128 and have an inclined face 204 which are aligned with the rollers 172 which, as previously described, are mounted on the shafts 170.

The inclined face 204 has a sufficient elevating extent to elevate the heater support blocks 168 to the raised position to an extent sufficient to raise the second abuttment finger 198 out of contact with the first abuttment bar 36.

For the purposes of folding the distal end portion, a hook shaped turn over bar 206 is mounted on a shaft 208 which has its opposite ends mounted in the ramps 202. The hook bar 206 will normally depend from the shaft 208 with the hook end 210 located in the position shown in FIG. 7 of the drawings. The turn over bar 206 is free to pivot about the shaft 208 to and fro in the direction of the arrows 212.

A hold-down plate 212 is secured to the downstream face of the second bridge 128 by means of mounting screws 214. The holddown plate 212 is longitudinally elongated and has a sufficient length to provide a dwell time in contact with the folded flange which is sufficient to insure that the folded flange will cool and set in the folded configuration as will be described hereinafter.

FOLDING OF LEADING END FLANGE

As shown in FIG. 7 of the drawings, the heater support block 168 assumes the inclined position when the carriage 138 is in the advanced position. Within the inclined position the heater support block 168 supports the heater element 180 above the level of the leading end flange 44 which is supported by the oncoming carriage 20.

As the carrier 20 advances the leading end flange 44 passes under the heater element 182 and when the abuttment 36 engages the fingers 198 of the second abuttment the heat support block 168 will be caused to pivot about the shaft 170 in a counterclockwise direction thereby moving the heater element 180 into the position shown in FIG. 8 of the drawings wherein it bears against the leading end flange 44 and is located above the resilient pad 33. Continued movement of the carriage 20 drives the heater assembly 134 in the direction of the arrow A away from the advanced position shown in FIG. 7. When the heater assembly 134 moves to a position wherein the rollers 172 of the heater assembly 134 make contact with the inclined face 204 of the elevator ramps 202 further movement of the heater assembly 134 will cause the heat support block 168 to move toward its elevated position until such time as the fingers 198 are raised above the first abutting bar 36. Simultaneously, the heater element 180 is raised out of engagement with the leading end flange 44. After disengagement of the fingers 198 and the first abuttment bar 36 the weights 148 will act on the heater assembly 134 to cause it to return to the advanced position shown in FIG. 7. The shock absorbing buffer 156 will collide with the adjustable buffer 126 during movement of the heater assembly 134 toward the advanced position and the shock absorbing buffer 156 will absorb the shock of the impact. The biasing mechanism 184 will operate to relocate the heater support block 168 in the inclined position shown in FIG. 7. Thus, it will be seen that the heater element 180 is brought into contact with the leading end flange 44 and maintained in contact therewith during movement of the heater assembly 134 over substantially the full travel of the heater assembly from its advanced position to its retracted position thereby to provide a sufficient dwell time to insure that the leading end flange 44 is heated along the required fold line to an extent sufficient to make it readily foldable.

The stripper bar 183 serves to separate the heating element 180 from the heated leading end flange 44 as the heating element 180 is raised.

As shown in FIG. 9 of the drawings the turnover bar 206 normally depends with its hook end 210 located below the level of the oncoming leading end flange 44.

The distal end portion **44*a* will normally assume a slight upward inclination as illustrated in FIG. 9 and will be driven into engagement with the turnover bar 206 as the carrier 20 advances. The turnover bar 206 will pivot from the position shown in FIG. 9 to the position shown in FIG. 10 thereby causing the distal end 44*a* to be folded upwardly and further movement of the carrier 20 will cause the distal end to be folded to an overlying relationship with respect to the proximal end 44*c* and folding will occur along the fold line 44*b*. Continued movement of the carrier 20 will cause the folded flange to pass under the turnover bar 206 and under the hold-down plate 212 as shown in broken lines in FIG. 10. The length of the hold-down plate 212** is selected to insure that the folded flange will cool to a sufficient extent to become permanently set in the folded configuration before it is released by the holddown plate.

From the foregoing it will be apparent that the flange forming machine of the present invention is capable of continuous high speed operation.

I claim:

1. A flange folding machine for folding the distal end of the flanges of a blister package or the like inwardly upon the proximal ends thereof to form closure panel receiving channels comprising:

(a) a plurality of carriers mounted on a conveyor for continuous movement along a path which extends through a folding station, each carrier being adapted to support a package with the distal ends of its flanges projecting outwardly therefrom;

(b) side flange folding means in said folding station at opposite sides of said path for folding the distal ends of the side flanges along a first fold line, said side flange folding means having a first length adapted to fold the distal end of the side flanges to an upright position and a second length adapted to fold the distal end of the flanges inwardly to overlie their proximal ends, said flange folding means including mandrel means extending along said second length and located at said fold line whereby the flanges are folded around said mandrel means to form inwardly opening channels which have a wide base to facilitate the sliding of a closure panel therealong; and (c) first heater means located in close proximity to each first fold line and extending along at least a major portion of said first length and being operable to heat said side flanges to a sufficient extent to render them formable.

2. A flange folding machine as claimed in claim 1 wherein said mandrel means comprises a thin longitudinally elongated rod around which the distal end of each flange may be folded to assume a toed-in position with respect to its underlying proximal end so as to cooperate therewith to retain a closure panel therebetween in use.

3. A flange folding machine as claimed in claim 1 wherein each flange folding means further comprises:

(a) an anvil extending longitudinally of said first length of said folding station and arranged to overlie the proximal end of a side flange as it is driven through said station, said anvil having a folding edge extending along said folding line;

(b) said mandrel means comprising a thin rod which extends from said anvil along said fold line; and (c) first plough means disposed opposite said anvil and adapted to engage the distal end of a side flange as it is driven along said path and to fold it to said upright position and second plough means disposed opposite said mandrel and adapted to fold the distal end of the flange inwardly upon the proximal end thereof as aforesaid.

4. A flange forming machine as claimed in claim 1 having leading end flange forming means for folding the distal end portion of a leading end flange inwardly upon the proximal end portion thereof along a transverse fold line comprising:

(a) heater means slidably mounted for reciprocating movement in said folding station to and fro along said path between a forward position and the retracted position, said heater means being operable to heat the leading end flange of successive packages along their transverse fold lines, said heater means and each carrier having complementary abuttment means arranged to butt against one another thereby to cause the heater means to travel with successive carriers from said forward position to said retracted position to provide a sufficient dwell time to permit the heater means to render the leading end flange foldable along said transverse fold line;

(b) release means for releasing said abutting means when said heater means reaches said retracted position;

(c) return means for returning said heater means to said forward position; and (d) end flange folding means mounted in said folding station and arranged so as to engage said leading end flange and fold the distal end thereof along said transverse fold line to a position overlying said proximal end as said carrier is driven continuously through said folding station.

5. A flange forming machine as claimed in claim 4 wherein said heater means comprises:

(i) a carriage which is slidably mounted as aforesaid;

(ii) heater support means pivotally mounted on said carriage for angular movement about a first axis extending transversely of said path, said heater support means having an upstream end and a downstream end located upstream and downstream of said path with respect to said first axis, said heater support means being angular moveable between a first position in which the upstream end is elevated above said path and a second position in which the upstream end is lowered toward said path, said heater support means also being mounted to reciprocate bodily between a lowered position and a raised position;

(iii) a heater element mounted on said upstream end of said heater support means;

(iv) a first of said complimentary abuttment means being mounted on said downstream of said heater support means and a second of said abuttment means being mounted on each carrier whereby engagement of said first and second abuttment means causes said heater support means to pivot angularly about said first axis to lower said heater element into heat exchange relationship with a flange of a package carried by said carrier;

(v) elevator means located adjacent the retracted position of said heater means so as to engage said heater support means and move it to its raised position to move the heating element away from the end flange which it has heated and to disengage said first and second abuttment means to permit said carriage to return to its advanced position to be available to a subsequent carrier.

6. A flange folding machine as claimed in claim 5 including stripper means on said carriage adjacent said heater bar for separating a heated end flange from the heater bar as the heater bar is elevated to its raised position.

7. A flange folding machine as claimed in claim 4 wherein said end flange folding means comprises a hook-shaped turnover bar pivotally mounted above said path and depending from its pivotal mounting to locate the hook shaped portion thereof in said path in a position to underlie successive on-coming heated leading end flanges and being operable to engage and fold the distal end portion over the proximal end portion and then pivot out of engagement therewith.

8. A flange folding machine as claimed in claim 5 further comprising a frame extending longitudinally of said folding station, said frame having an upper guide rail disposed above said path and a pair of side guide rails disposed one on either side of said path and extending longitudinally thereof, said carriage being slidably mounted on said guide rails, a first bridge member securely mounted at the upstream end of said folding station and bridging said path, said first bridge member supporting said guide rails, a second bridge member at the downstream end of said folding station supported by said guide rails, said elevator means and end flange folding means being mounted on said second bridge member.

9. A flange folding machine as claimed in claim 4 further comprising a hold-down plate extending rearwardly from said folding station above said path so as to retain the flanges in their folded position for a period of time sufficient to permit cooling of the flanges to a setting temperature.

* * * * *